United States Patent [19]

Sakaki

[11] 4,068,708

[45] Jan. 17, 1978

[54] SEAL ASSEMBLY IN ROTARY REGENERATIVE HEAT EXCHANGER

[75] Inventor: Yoshihiro Sakaki, Suwa, Japan

[73] Assignee: Nissan Motor Co., Ltd., Yokohama, Japan

[21] Appl. No.: 668,073

[22] Filed: Mar. 18, 1976

[30] Foreign Application Priority Data

Mar. 24, 1975 Japan ..... 50-38355[U]

[51] Int. Cl.[2] ..... F28D 19/00

[52] U.S. Cl. ..... 165/9; 277/92; 277/165

[58] Field of Search ..... 165/9; 277/81 R, 96, 277/96.1, 96.2, 228, DIG. 6, DIG. 9, 92, 94, 95, 165

[56] References Cited

U.S. PATENT DOCUMENTS

| | | | |
|---|---|---|---|
| 3,180,402 | 4/1965 | Moffat | 165/9 |
| 3,633,926 | 1/1972 | Graham et al. | 165/9 |
| 3,780,791 | 12/1973 | Barnard et al. | 165/9 |
| 3,893,505 | 7/1975 | Fujikake et al. | 165/9 |
| 3,931,852 | 1/1976 | Rao | 165/9 |
| 3,939,903 | 2/1976 | Sakaki et al. | 165/9 |
| 3,957,106 | 5/1976 | Whitfield | 165/9 |

FOREIGN PATENT DOCUMENTS

| | | | |
|---|---|---|---|
| 2,126,940 | 10/1972 | France | 165/9 |
| 975,027 | 11/1964 | United Kingdom | 165/9 |

*Primary Examiner*—Charles J. Myhre
*Assistant Examiner*—Sheldon Richter

[57] ABSTRACT

A seal assembly for providing seal between an end face of a cylindrical and rotatable heat-transferring member and an opposite surface of a stationary member of the heat exchanger, having a loop-shaped and cross-sectionally rectangular seal member of a heat-resistant and rigid material, a loop-shaped groove formed in the surface of the stationary member to loosely receive the seal member, a loop-shaped back-up member of a resilient material tightly received in the bottom of the groove such that the seal member is sandwiched with a compressive force between the back-up member and the end face of the heat-transferring member, and a loop-shaped auxiliary seal member of a resilient material arranged to provide seal between the outer surface of the seal member and the outer wall of the groove and press the seal member against the inner wall of the groove.

7 Claims, 6 Drawing Figures

SEAL ASSEMBLY IN ROTARY REGENERATIVE HEAT EXCHANGER

This invention relates to a rotary regenerative heat exchanger, and more particularly to a seal assembly for providing seal between a rotatable heat-transferring member and a stationary block member of the heat exchanger.

A rotary regenerative heat exchanger for accomplishing heat exchange between two fluids, which are usually at different pressures as exemplified by a combustion gas and compressed air in a gas turbine, has a heat-transferring member which is rotatable and moves alternately through the two fluids. The heat exchanger has some seal assemblies to provide seal between the rotating heat-transferring member and a stationary member forming therein fluid passages for the respective fluids and prevent any leakage of the highly pressurized fluid into the other fluid in a heat exchange section of the apparatus. A seal assembly for this purpose includes a seal member which is made of a heat-resistant and rigid material and a back-up member of a resilient material which forces the seal member to be kept in contact with an end face of the heat-transferring member with an adequate compressive force.

Conventional seal assemblies for this purpose involve some problems. Firstly, the back-up member tends to deteriorate and gradually lose its resilient property by the influences of the fluids subjected to heat exchange. Besides, the back-up member and the seal member are liable to lean in a certain direction with respect to the contact surface between the heat-transferring member by the effect of a pressure difference between the two fluids, so that the seal member suffers from a local and noticeable wear. These problems will be explained hereinafter more practically.

Figure 1:
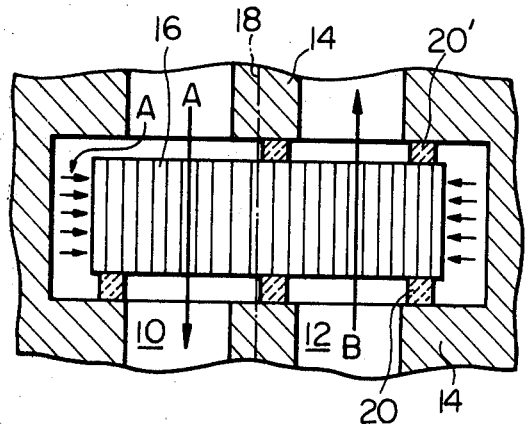
FIG. 1 is a fragmentary and sectional side elevation of a rotary regenerative heat exchanger.
Figure 2:
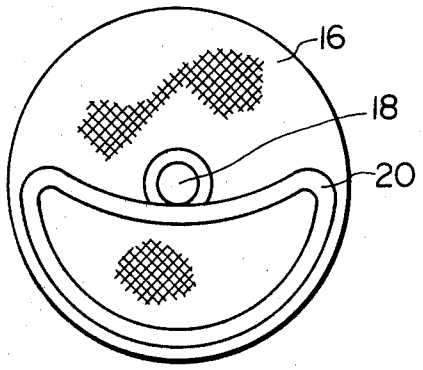
FIG. 2 is a plan view of the rotatable and cylindrical heat-transferring member of the heat exchanger of FIG. 1 and a seal member placed on an end face of the heat-transferring member.

Referring to FIG. 1, a rotary regenerative heat exchanger has two fluid passages: a first fluid passage 10 for passing a relatively cold fluid such as compressed air indicated at A and a second fluid passage 12 for passing a heated fluid such as a combustion gas B which is usually at a lower pressure than the cold fluid A. These fluid passages 10 and 12 are generally isolated from one another by a stationary block member 14, but a partition wall of the block member 14 is cut to form a wide chamber which spreads over the two fluid passages 10 and 12 for the installation of a cylindrical and rotatable heat-transferring member 16 in this chamber. The heat-transferring member 16 revolves on its longitudinal axis 18 and moves alternately through the first and second fluid passages 10 and 12. Therefore, loop-shaped seal members 20 and 20' are secured to the end walls of the cylindrical chamber so as to be in slide contact respectively with the front and back end faces of the heat-transferring member 16 as seen in FIGS. 1 and 2. The function of the heat-transferring member 16, which is usually made of metal plates in spaced layers, will need no explanation. Since there is a pressure difference between the cold fluid A and the heated fluid B, a certain pressure balance measure is needed to allow the heat-transferring member 16 to revolve smoothly. Therefore, the pressurized and cold fluid A is introduced into a peripheral region of the cylindrical chamber so that the fluid pressure of this fluid A may be applied to the side surface of the heat-transferring member 16 in radial directions uniformly over the entire area. As a result, the outer surface of each seal member 20 or 20' is exposed to the pressurized fluid A and the inner surface is exposed to the heated fluid B.

Figure 3:
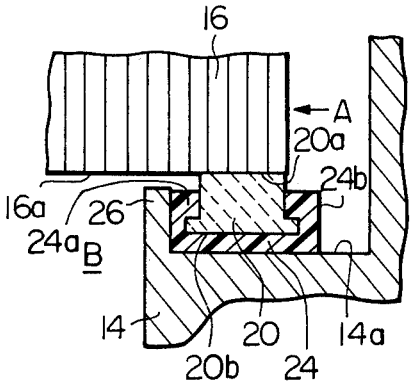
Fig. 3 PRIOR ART
FIG. 3 is a fragmentary and sectional view of a conventional seal assembly, including the seal member of FIG. 2, in the heat exchanger of FIG. 1.

FIG. 3 shows the construction of a conventional seal assembly in the rotary regenerative heat exchanger of FIG. 1. The block member 14 has a surface **14*a* as an end wall of the aforementioned cylindrical chamber. An end face 16*a* of the cylindrical heat-transferring member 16 is partly opposite to and spaced from this surface 14*a*. The loop-shaped seal member 20 is fundamentally made from a heat-resistant material such as carbon and has a flat surface 20*a* over the entire length to be kept in slide contact with the end face 16*a* of the heat-transferring member 16. The seal member 20 is secured to a loop-shaped back-up member 24, which is made of a resilient and adequately heat-resistant material such as silicone rubber, such that a portion of the back-up member 24 over the entire length is inserted between the wall 14*a* and a surface 20*b* (reverse of the contact surfaces 20*a*) of the seal member 20 and pressed against the wall 14*a***.

A projection 26 is formed on the wall **14*a* along the inner surface of the back-up member 24 to prevent the back-up member 24 and the seal member 20 from being moved or deformed by the fluid pressure acting on the outer surfaces of the back-up member 24 and the seal member 20. The function of the seal assembly of FIG. 3 is satisfactory so long as the seal member 20 and the back-up member 24 remain in the illustrated state. Since the end face 16*a* of the heat-transferring member 16 slides over the surface 20*a* of the seal member 20 which is pressed against the end face 16*a*, the seal member 20** serves as a lubricant when made of carbon and exhibits a good antiwear property.

One of the disadvantages of this seal assembly is exposure of the back-up member 24 to a high temperature atmospheres. An inner portion **24*a* of the back-up member 24 is exposed to the heated fluid B of which temperature is usually about 300° C when the heated fluid B is a combustion gas, so that the back-up member 24 is liable to be damaged by heat and/or chemical erosion. An outer portion 24*b* of the back-up member 24 is exposed to the "cold" fluid A, but the cold fluid A becomes a heated fluid upon contact with the revolving heat-transferring member 16. When the cold fluid A is compressed air, a temperature of about 200° C is realized easily. The heating and/or erosion by the fluids results in that the back-up member 24 loses its resilience and cannot press the seal member 20 against the end face 16*a* of the heat-transferring member 16** with a satisfactorily large and uniformly distributed compressive force.

Figure 4:
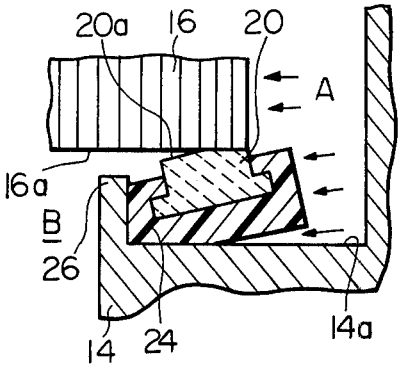
FIG. 4 shows with exaggeration the same seal assembly in a deformed state.

Apart from high temperatures of the fluids, there is a pressure difference by about 3 kg/cm², for example, between the compressed air and the combustion gas whereas the back-up member 24 is supported by the block member 14 only partly and unsymmetrically. When the back-up member 24 is pressed against the projection 26 due to the pressure difference, the back-up member 24 exhibits a certain deformation in a region adjacent the inner surface and is detached from the wall 14*a* in another region adjacent the outer surface as shown in FIG. 4. Then the surface 20*a* of the seal member 20 cannot be kept in contact with the end face 16*a* of the heat-transferring member 16 over the entire area of the surface 20*a*. As seen in FIG. 4, the surface 20*a* is detached from the end face 16*a* in an inner region but is pressed with an extremely strong force against the end face 16*a* in an outer region: the contact between the heat-transferring member 16 and the seal member 20 is established only over a very small area. Consequently both the heat-transferring member 16 and the seal member 20 are worn out noticeably in the thus limited and localized contact area.

In regard to a rotary regenerative heat exchanger, it is an object of the present invention to obviate these drawbacks of conventional seal assemblies.

It is another object of the invention to provide an improved seal assembly in association with a rotatable heat-transferring member of the heat exchanger in which a slide contact between the heat-transferring member and a seal member is maintained uniformly with a constant compressive force over a constant area even when the seal assembly is used for separating two different fluid pressures and a resilient back-up member is prevented from exposure to heated and/or pressurized fluids.

In a rotary regenerative heat exchanger having a heat-transferring member which is cylindrical and rotatable on its longitudinal axis and a stationary block member having a surface opposite to and spaced from an end face of the heat-transferring member, a seal assembly according to the invention comprises: (a) a loop-shaped seal member of a heat-resistant and substantially rigid material having an outer surface, an inner surface, a flat front surface stretched between the outer and inner surfaces and a back surface; (b) a loop-shaped groove formed in the aforementioned surface of the block member to have a width larger than the width of the seal member; and (c) a loop-shaped back-up member of a resilient material tightly received in the groove such that the front surface and the back surface of the seal member are kept in contact with the end face of the heat-transferring member and the back-up member, respectively. The back-up member is sandwiched with a compressive force between the back surface of the seal member and the bottom of the groove when the front surface of the seal member is in contact with the end face of the heat-transferring member. The seal assembly further comprises (d) a loop-shaped auxiliary seal member of a resilient material arranged in the groove to provide seal between the outer wall of the groove and the outer surface of the seal member and keep the inner surface of the seal member in contact with the inner wall of the groove with a compressive force.

Preferably, the back-up member and/or the groove are shaped such that a loop-shaped space is formed in the groove partly defined by the inner wall of the groove and an inner extreme region of the back surface of the seal member so that an inner corner portion of the back-up member may not be pinched between the inner wall and the seal member.

Other features and advantages of the invention will become apparent from the following detailed description of preferred embodiments with reference to the accompanying drawings.

A seal assembly according to the invention is used at the same places in the heat exchanger as the conventional seal assembly described hereinbefore with reference to FIGS. 1–3. In a first embodiment of the invention shown in FIG. 5, a seal member 30 is formed as a loop like the seal member 20 of FIG. 20 and has a rectangular cross section. This seal member 30 is made of a usual material comprising porous carbon as a fundamental component. Two parallel sides 31 and 32 of the rectangle are given respectively by outer and inner side surfaces of the loop-shaped seal member 30, and one (33) of the remaining two parallel sides 33 and 34 is given by a front surface to be kept in contact with the end face 16*a* of the heat-transferring member 16. A groove 40 is formed in the surface 14*a* of the block member 14 to have the same loop-shape as the seal member 30 and a rectangular cross section. The width of the groove 40, i.e., the distance between outer and inner walls 41 and 42, is slightly larger than the width of the seal member 30, i.e., the distance between the outer and inner surfaces 31 and 32. A resilient back-up member 50, which also has the same loop-shape as the seal member 30 and a rectangular cross section, is tightly received in the groove 40 so that a surface 54 of the back-up member 50 is pressed against the bottom wall 43 of the groove 40. The width of the back-up member 50 is nearly equal to the width of the groove 40 so that outer and inner surfaces 51 and 52 of the back-up member 50 are respectively in intimate contact with the outer and inner walls 41 and 42 of the groove 40 at least when the back-up member 50 is pressed against the bottom wall 43. The depth of the groove 40 is larger than the thickness of the back-up member 50 but is smaller than the total thickness of the seal member 30 and the back-up member 50. The seal member 30 is received in the groove 40 such that the back surface 34 is in contact with the exposed surface 53 of the back-up member 50. In this state, the front surface 33 of the seal member 30 is out of the groove 40 and in contact with the end face 16*a* of the heat-transferring member 16. The seal member 30 provides an effective seal between the heat-transferring member 16 and the block member 14 since the surface 33 of the seal member 30 is always pressed against the end face 16*a* with an adequate compressive force resulting from a repulsive action of the compressed back-up member 50. The inner surface 32 of the seal member 30 is kept in contact with the inner wall 42 of the groove 40, so that a gap 60 is formed between the outer surface 31 of the seal member 30 and the outer wall 41. To prevent the back-up member 50 from being exposed to the fluid A passing through the first fluid passage 10 of FIG. 1, a loop-shaped auxiliary seal member 70 is installed in this gap 60 to provide seal between the outer surface 31 and the outer wall 41. A groove 35 may be formed in the outer surface 31 to secure the auxiliary seal member 70.

Both the back-up member 50 and the auxiliary seal member 70 are made of a resilient and adequately heat-resistant material such as silicone rubber. The block member 14, at least in a portion forming therein the groove 40, is preferably made of a metal such as aluminum which has a good heat conductivity so that the back-up member 50 and the auxiliary seal member 70 may be relieved from being heated excessively.

Figure 5:
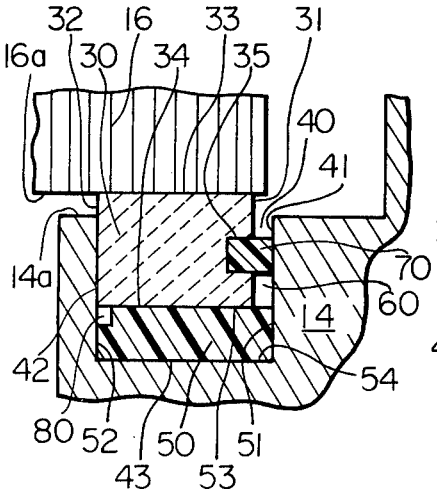
FIG. 5 is a fragmentary and sectional view of a seal assembly according to the invention in association with the heat exchanger of FIG. 1.

In the embodiment of FIG. 5, the back-up member 50 is cut at a corner region between the surfaces 52 and 53 over the entire length, so that a space 80 is formed in the seal assembly. This space 80 is partly defined by the wall 42 of the groove 40 and the inner surface 32 of the seal member 30 and has a far smaller cross-sectional area than the back-up member 50. The space 80 is formed for the purpose of preventing the occurrence of incomplete sealing between the wall 42 and the inner surface 32 of the seal member 30 as the result of intrusion of the corner region of the back-up member 50 when the back-up member 50 is compressed by the seal member 30.

As seen from the foregoing description, the back-up member 50 is kept isolated from the two fluids A and B passing through the heat exchanger. Accordingly, the back-up member 50 exhibits little deterioration by heat and makes no detachment from the bottom wall 43 of the groove 40 even if there is a great pressure difference between the two fluids A and B. In addition to the provision of seal between the wall 41 and the outer surface 31 of the seal member 30, the auxiliary seal member 70 causes the seal member 30 to be in contact with the block member 14 at the inner surface 32 and make no lateral movement (viewed in FIG. 5). In other words, the seal member 30 which is a practically rigid member is supported by the block member 14 which also is a rigid and stationary member against a fluid pressure acting on the surface 31. The seal member 30, therefore, does not lean inwards to cause a decrease in the contact area between the surface 33 and the end face **16*a* of the heat-transferring member 16 even though the outer surface 31 of the seal member 30 is partly exposed to the pressurized fluid A. Even if the pressurized fluid A leaks into the space between the auxiliary seal member 70 and the back-up member 50, neither the back-up member 50 nor the seal member 30 cannot easily lean to any direction to cause an ununiform contact between the seal member 30 and the heat-transferring member 16. If the contact surface between the surface 34 of the seal member 30 and the surface 53 of the back-up member 50 is forced to let in the leaked fluid A, the intruded fluid A will not remain in the groove 40 and cause leaning of the seal member 30, but will flow out of the groove 40 through the contact surface between the two surfaces 32 and 42 of the two rigid members 30 and 14**.

Thus, the back-up member 50 in a seal assembly according to the invention is protected against deterioration by heat and erosion resulting from exposure to a reactive fluid such as a combustion gas and accordingly can exert an adequate compressive force on the seal member 30 for a prolonged period of time. Any leaning of the seal member 30 with respect to the end face **16*a* of the heat-transferring member 16 is precluded, so that the seal member 30** can provide a constant contact area with an almost constant compressive force without exhibiting any ununiform wear.

The seal member 30 of the seal assembly according to the invention is not fundamentally different from the seal member 20 in the conventional seal assembly as described hereinbefore. It is necessary, however, that the inner surface 32 of the seal member 30 can be brought into intimate contact with the inner wall 42 of the groove 40 in the seal assembly of the invention. Since the seal member 30 is made of a practically rigid material, it is difficult to realize an intimate contact between the seal member 30 and the wall 42 over the entire length if the seal member consists of a single member. In practice, the seal member 30 consists of a plurality of pieces which may be considered as the result of dividing a loop transversally into a plurality of sections. These pieces are shaped and sized that the individual pieces can move radially of the loop when arranged in a row within the groove 40. The lengths of the dividual pieces are determined precisely so that the lateral and narrow gaps between the adjacent pieces may practically disappear when the auxiliary seal member 70 is assembled with these pieces to press them together against the wall 42.

Figure 6:
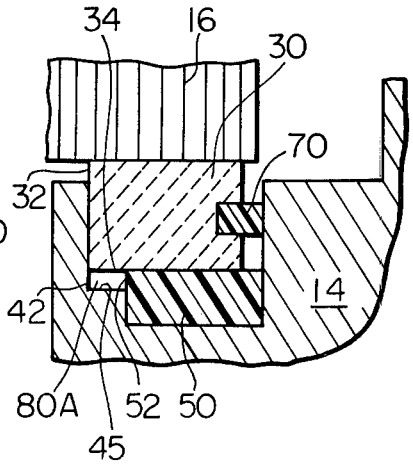
FIG. 6 is a generally similar view to FIG. 5 but shows a slight modification of the seal assembly.

FIG. 6 shows a slightly modified embodiment in regard to the space 80 in FIG. 1 for preventing the back-up member 50 from being pinched by the wall 42 and the seal member 30. In the seal assembly of FIG. 6, the back-up member 50 is not cut at any corner region but has a slightly smaller width than the width of the groove 40. A shoulder 45 is formed at an extremely inner region of the bottom wall 43 of the groove 40 so that a space 80A of a rectangular cross section is defined by the surface 34 of the seal member 30, the inner surface 52 of the back-up member 50, the shoulder portion 45 of the wall 43 and the inner wall 42 of the groove 40 over the entire length of the loop-shaped groove 40. In other respects, the seal assembly of FIG. 6 is identical with the seal assembly of FIG. 5.

What is claimed is:

1. In a rotary regenerative heat exchanger having a heat-transferring member which is cylindrical and rotatable on the longitudinal axis thereof and a stationary block member having a surface opposite to and spaced from an end face of the heat-transferring member, a seal assembly for providing seal between said end face and said surface, comprising:

a loop-shaped seal member having a substantially rectangular configuration of a heat-resistant and substantially rigid material having an outer surface, an inner surface, a flat front surface stretched between said inner and outer surfaces and a back surface;

a loop-shaped groove having a substantially rectangular configuration formed in said surface of the block member to have a width larger than the width of said seal member, said groove having an inner wall;

a loop-shaped back-up having a substantially rectangular configuration member of a resilient material tightly received in said groove, said seal member being received in said groove such that said front surface and said back surface of said seal member are kept in contact with said end face of the heat-transferring member and said back-up member, respectively, said back-up member being sandwiched with a compressive force between said back surface of said seal member and the bottom of said groove when said front surface is in contact with said end face, at least one of said groove and said back-up member being shaped such that a loop-shaped space is formed in said groove partly defined by said inner wall and an inner extreme region of said back surface, so that part of an inner surface of said back-up member comes into no contact with part of said inner wall of said groove; and a loop-shaped auxiliary seal member of a resilient material arranged in said groove to provide seal between an outer wall of said groove and said outer surface of said seal member and keep said inner surface of said seal member in intimate contact with said inner wall of said groove with a compressive force.

2. A seal assembly as claimed in claim 1, wherein said back-up member is cut at a corner region over the entire length to form said space.

3. A seal assembly as claimed in claim 1, wherein said heat-resistant and substantially rigid material comprises carbon as a fundamental component.

4. A seal assembly as claimed in claim 1, wherein said back-up member and said auxiliary seal member are made of silicone rubber.

5. In a rotary regenerative heat exchanger having a heat-transferring member which is cylindrical and rotatable on the longitudinal axis thereof and a stationary block member having a surface opposite to and spaced from an end face of the heat-transferring member, a seal assembly for providing seal between said end face and said surface, comprising:

a loop-shaped seal member having a substantially rectangular configuration of a heat-resistant and substantially rigid material having an outer surface, an inner surface, a flat front surface stretched between said inner and outer surfaces and a back surface;

a loop-shaped groove having a substantially rectangular configuration formed in said surface of the block member to have a width larger than the width of said seal member, said groove having an inner wall;

a loop-shaped back-up having a substantially rectangular configuration member of a resilient material tightly received in said groove, said seal member being received in said groove such that said front surface and said back surface of said seal member are kept in contact with said end face of the heat-transferring member and said back-up member, respectively, said back-up member being sandwiched with a compressive force between said back surface of said seal member and the bottom of said groove when said front surface is in contact with said end face, at least one of said groove and said back-up member being shaped such that a loop-shaped space is formed in said groove partly defined by said inner wall and an inner extreme region of said back surface, so that part of an inner surface of said back-up member comes into no contact with part of said inner wall of said groove; said bottom wall of said groove being shaped to have a shoulder portion contiguous to said inner wall, said back-up member extending from said outer wall to the outer end of said shoulder portion; and a loop-shaped auxiliary seal member of a resilient material arranged in said groove to provide seal between an outer wall of said groove and said outer surface of said seal member and keep said inner surface of said seal member in intimate contact with said inner wall of said groove with a compressive force.

6. A seal assembly as claimed in claim 5, wherein said heat-resistant and substantially rigid material comprises carbon as a fundamental component.

7. A seal assembly as claimed in claim 5, wherein said bakc-up member and said auxiliary seal member are made of silicone rubber.

* * * * *